United States Patent [19]

Hendriks

[11] 4,069,642

[45] Jan. 24, 1978

[54] STORAGE TANK HAVING A PROTECTIVE WALL CONSTRUCTION

[75] Inventor: Nicolaas Arie Hendriks, Rotterdam, Netherlands

[73] Assignee: Bouwmaatschappij Nederhorst B. V., Gouda, Netherlands

[21] Appl. No.: 640,536

[22] Filed: Dec. 15, 1975

[30] Foreign Application Priority Data

Aug. 19, 1975 Netherlands ..... 7509841

[51] Int. Cl.[2] ..... E04B 2/02

[52] U.S. Cl. ..... 52/224; 52/247; 52/249

[58] Field of Search ..... 52/224, 249, 247, 245

[56] References Cited

U.S. PATENT DOCUMENTS

| | | | |
|---|---|---|---|
| 1,964,870 | 7/1934 | Chappell | 52/249 |
| 2,903,877 | 9/1959 | Meade | 52/249 |
| 2,953,276 | 9/1960 | Dunn | 52/245 |
| 3,047,184 | 7/1962 | Van Bergen | 52/249 |
| 3,076,317 | 2/1963 | LaFave | 52/249 |
| 3,151,416 | 10/1964 | Eakin | 52/249 |
| 3,233,376 | 2/1966 | Naillon | 52/224 |
| 3,397,503 | 8/1968 | Adler | 52/224 |
| 3,397,503 | 8/1968 | Adler | 52/224 |
| 3,423,264 | 1/1969 | Miron | 52/249 |
| 3,633,328 | 1/1972 | Closner | 52/224 |
| 3,719,982 | 3/1973 | Tindal | 52/224 |

FOREIGN PATENT DOCUMENTS

| | | | |
|---|---|---|---|
| 1,383,795 | 11/1964 | France | 52/249 |
| 1,048,446 | 12/1953 | France | 52/224 |

*Primary Examiner*—Price C. Faw, Jr.
*Assistant Examiner*—Henry Raduazo
*Attorney, Agent, or Firm*—Scully, Scott, Murphy & Presser

[57] ABSTRACT

Storage tank for liquids presenting a danger to the environment, such as liquid natural gas, ethylene, propylene and the like. The tank comprises an inner tank and a concrete outer tank, an insulating material, the wall of the outer tank being a rigid prestressed concrete wall adjoining other structural parts.

4 Claims, 5 Drawing Figures

STORAGE TANK HAVING A PROTECTIVE WALL CONSTRUCTION

The present invention relates to a storage tank for liquid materials such as liquid natural gas, ethylene, propylene, ammonia, etc., including a bottom plate, an inner tank and an outer tank of concrete, as well as preferably insulating material.

The object of the invention is to provide a construction for a tank of the above type, which can be built economically and offers a high degree of protection against the results of a calamity particularly in the case of dangerous liquids and especially liquids of extremely low temperature.

The storage tank according to the invention is characterized by a prestressed concrete wall which is rigid owing to its construction and connection to and against other structural parts of the storage tank, and a space providing thermal insulation between said wall and the inner tank, with preferably thermally insulating material arranged in said space, possibly filling said space. In addition to the possibility of insulation through free interspace in which there may be air or gas, the invention provides for the purpose for the use of insulating materials having outstanding thermal insulation characteristics while allowing for their remaining characteristics, all this being such as will appear hereunder. A thermal insulating material used is of a special polyurethane type manufactures, for example, by Farben Fabriken Bayer A.G. of Leverkusen. At very low temperature, for instance −200° C, this type still retains some elasticity. For the sake of brevity, foam material of this type will be referred to as "purfoam".

The invention also relates to a method of building the above storage tank in such a manner as to obtain the contemplated properties optimally and economically.

The invention will now be elucidated with reference to the drawings showing one embodiment. In the drawings FIG. 1 shows a storage tank according to the invention in side elevational view with at the top and the bottom one part in vertical section;

Figure 1:
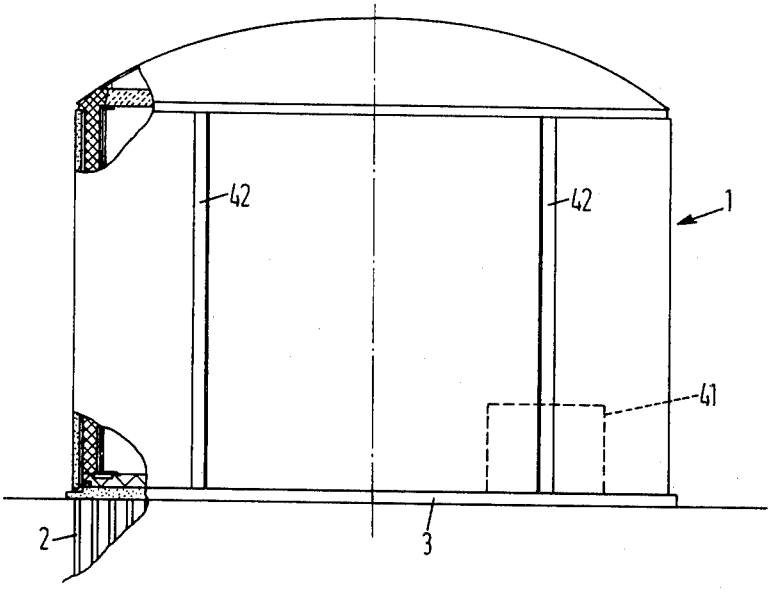

In the embodiment illustrated the circular cylindrical tank, in the drawings shown in full by 1, is built on piled foundations 2, on which the baseplate 3 of reinforced concrete is supported. This baseplate has a recessed circumferential part 4, so that a central cylindrical portion 5 is formed, about which the lower end of the wall construction fits.

The protective-strength producing part of this wall construction, to be referred to as the protective wall, is constructed as a concrete wall 7 circumferentially prestressed by means of tensioned wires 6. Tensioned wires 6 do not bond to the concrete, to which end they are arranged in a special grease in a flexible envelope 8, like a plastic tube, so that they can be tensioned well. Each of the tensioned wires embraces part of the circumference, they are staggered circumferentially so as to overlap, for example, one-third part of the circumference.

The uniformness of the pre-stress produced in the wall obtained over the entire circumferential length of wall 7 by means of wires 6 causes the wall 7 to behave as a form-retaining construction, also with the temperature variations that may occur therein.

The wall 7 is supported on bottom portion 4 via a layer of mortar 9 of a type based on epoxy resin, and also on a number of separate, circumferentially spaced rubber blocks 10 embedded in the mortar 9.

Also the relatively narrow annular space between the lower end of the wall 7 and the circumference of the central baseplate portion 5 is filled with an annular layer of similer epoxy mortar 9'.

During its manufacture the wall 7 first rests only on rubber blocks 10. After being built up the wall 7 is pre-stressed horizontally resulting in a reduction in length of the wall. It is thus possible for the circular wall 7 to move freely in all inward directions on rubber blocks 10. After deformation as a result of horizontal pre-stress the wall 7 will shrink for quite some period and thereby move freely inwardly even further in all radial directions on rubber blocks 10 and hence assume its ultimate diameter dimension. After the shrinking period is completed, at least substantially, the annular mortar layer 9 is applied, preferably also annular layer 9', and furthermore a ring 9'' of concrete mortar to round off the transition between wall 7 and baseplate portion 5.

After hardening of the mortar 9,9' and 9'' the lower end of wall 7 is vertically prestressed by means of tensioned wires 11.

The pre-stressed wall 7 built up in this way and arrived at its ultimate diameter dimension owing to free creep and shrinkage and consequently fixed by vertical tensioning, forms a very rigid formretaining construction together with bottom plate 3,4,5.

With a view to moisture permeability the inside of wall 7 is coated with a moisture-repellant synthetic material layer 12, preferably of the above polyurethane type, while also the outside of wall 7 is coated with a layer 13 of said synthetic material. The layer 12 continues at the lower end with portion 12' over mortar ring 9'' and with a portion 12'' over baseplate portion 5. Layers 12, 13 are preferably applied for horizontally tensioning the concrete wall, because in that case the shrinkage as a result of tensioning and the subsequent creep take place in concrete in which a constant climate in respect of the moisture content prevails, which is of great importance for the ultimate strength of the wall. Besides a slight moisture content prevents frost damage to the wall after filling of the tank.

Against layer 12 a foam layer 14 of the type referred to above is applied, which would be called purfoam.

The foam layer 14 of said purfoam is highly thermally insulating and can easily be subjected to a sharply decreasing temperature gradient from the outside to the inside. At −200° C it still has some elasticity, nevertheless it should then be warranted against mechanical loads and internal forming stresses and subsequent deformation stresses as much as possible. To this end, layer 14 blends at its lower end via a curved or bevelled part 15 defined by ring 9'' with coating 12' into an annular bottom part 16 covered for protection purposes by a concrete layer 17 poured thereon.

The inner tank made for example of Ni-steel or of an Al-alloy has a wall 18 and a bottom 19 and rests on the central part 5 of the baseplate via an insulating layer 20 of foam glass, while a concrete ring is inserted below the circumferential zone of bottom 19.

Tank bottom 19 has a slightly larger diameter than tank wall 18. Above the ring portion of tank bottom 19, which ring portion is beyond tank wall 18, tank wall 18 is coated with a pair of layers 22 and 23 of slightly resilient insulating material like mineral wool. The space between the outer layer 23 of said two layers and foam layer 14 is filled with perlite insulating material 24.

Variations in diameter of tank wall 18 that may take place after completion of storage tank 1 when said tank is filled with ultra-cold contents are substantially compensated by the elasticity of coating layers 22 and 23.

The complete filling of the space between tank wall 18 and protective wall 7 prevents the liquid from flowing through a possible crack in tank wall 18 into the space between both walls, which would result in pulsations in inner tank 18, 19, which may have a capacity of tens of thousands of cubic meters, which pulsations would involve the occurrence of very great dynamic forces. The filling of the space between said walls with said insulating material prevents such events and serves in addition to insulating purposes also to warrant the foam layer 12 against mechanical loads.

Pre-stressed concrete, like that of wall 7, has greater strength at extremely low temperatures than at high temperatures. It is poorly resistant, however, to stresses as a result of too steep a temperature gradient. When storing the liquids having a very low temperature, like −160° C in the case of liquid natural gas, the foam layer 12 of special material has the advantage that it insulates wall 7 sufficiently against too low temperature and consequently prevents too great a temperature difference between inner and outer wall, while layer 12 itself can stand a steep temperature gradient. The temperature difference between the inside and outside of the concrete wall 7 can be about 40° C, starting from −162° C temperature of the tank contents and an average atmospheric outside temperature.

To increase the rigidity and the form retaining properties of the construction an exterior centering ring can be used on the baseplate, said ring being designated in the drawings in broken lines by numeral 25. Besides corresponding precautions can be taken against deformation and mechanical load of the purfoam, or suchlike material.

At the top the storage tank shown has a steel dome-shaped roof 26 from which a ceiling 30 of glass foam is suspended via suspensions 27 and section 28, 29. A wooden separation wall 31 is provided between the glass foam 30 and insulating material 24.

During the construction the dome-shaped roof is assembled within the concrete wall 7 already poured to fit with some play within wall 7. Subsequently air with some excess pressure relative to the atmosphere is introduced under the dome-shaped roof, as a result of which said roof 26 is lifted. It thereby contacts the obliquely upwardly extending leg 32 of ring profile 33 still resting on wall 7 with its vertical leg 34 inside or outside the thin-walled ring 35 embedded in the concrete of wall 7, and takes the ring profile 33 along upwardly till the place of destination is reached. The dome-shaped roof 26, ring profile 33, and ring 35 are then united at 36 and 37, respectively, e.g. by welding.

After the dome-shaped roof with the ceiling are brought in position, the steel inner tank 18, 19 and the various above-mentioned layers of thermal insulating material are installed. This working period which may take e.g. three months, mainly coincides with the period in which shrinkage of the concrete of wall 7 takes place.

In behalf of the supply of materials and mechanical handling aids, like a hoisting crane, an access or working opening is left in wall 7 during its construction. When the dome-shaped roof is pneumatically lifted said opening is temporarily closed with sheet work and after completion of the activities inside definitively filled with concrete, which is subsequently also pre-stressed.

Figure 5:
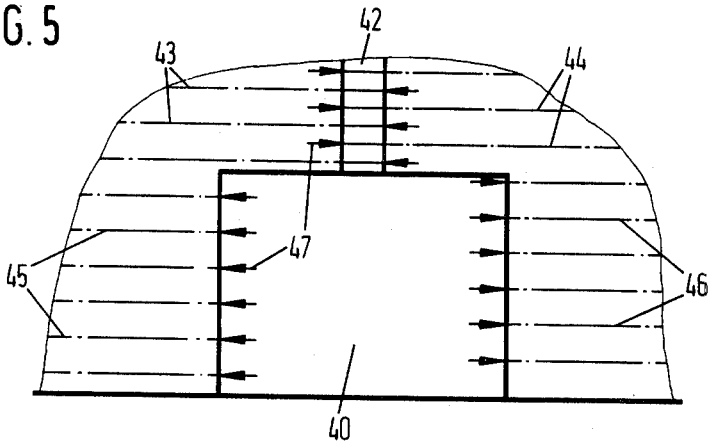
FIG. 5 shows the part in borken lines in FIG. 1 on a somewhat enlarged scale during one phase of manufacture.
Figure 2:
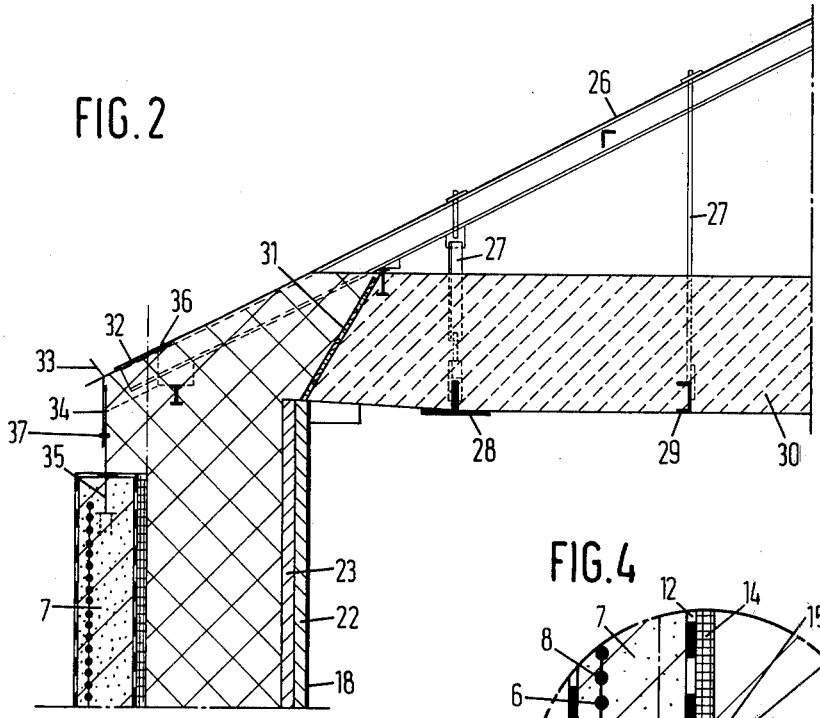
FIG. 2 shows the upper portion drawn in vertical section in FIG. 1 on an enlarged scale.
Figure 4:
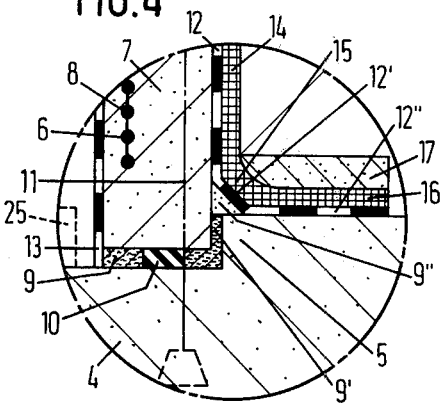
FIG. 4 shows the part encircled in FIG. 3 on a more enlarged scale.
Figure 3:
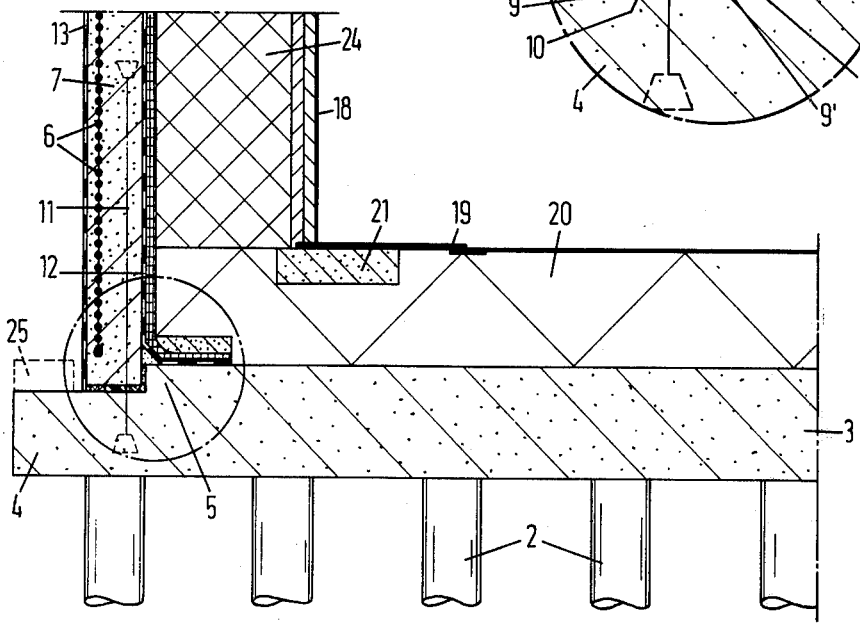
FIG. 3 shows the lower part drawn in vertical section in FIG. 1 on an enlarged scale.

In FIG. 1 the periphery of the working opening 40, of which use was made, is shown by broken line 41. The vertical centreline of the working opening is in line with one of the tensioned tibs 42, four of which are used in the embodiment shown. Reference numerals 43 and 44 in FIG. 5 refer to the tensioned wires designated by chain lines, insofar as they are positioned above the working opening, and numerals 45 and 46 refer to the tensioned wires running to one of the vertical sides of opening 40. The engagement of the reaction forces of the stress forces applied are indicated by arrow 47. When the opening 40 is definitively closed, first extension wires with associated sleeves 8 are connected to tensioned wires 45 and 46 by means of connections not shown, while at the same time the tensioned wires 11 necessary in this zone can be arranged. Then the opening 40 is poured to capacity, while the relevant tensioned rib 42 is also extended, as is shown in FIG. 1. After hardening of the concrete, places of engagement of the reaction forces of the stress forces in wires 45 and 46 are transferred to the extended tensioned rib 42. Finally, before tensioning vertical wires 11 it is possible to have a preceding shrinkage and creep period for the concrete in the former opening 40.

In the foregoing some main issues of the storage tank construction according to the invention are described and of the method according to the invention for constructing such a storage tank.

It will be clear that the invention is not limited to the main issues as described above and shown in the drawings but that variants are possible without departing from the scope of the present invention.

By applying these main issues protection is obtained not only against danger from external sources but also against unhoped-for failure of the inner tank. Tests have shown that the outer wall construction with its connection to the baseplate remains liquid-tight upon a sudden load with liquid nitrogen of −192° C. As a result, the contents of the inner tank cannot escape upon collapse of the inner tank. This can neither take place through evaporation, as the roof construction resting on the concrete outer wall is independent of the inner tank.

Neither can the liquid reach the foundation or baseplate construction owing to a special embodiment of the bottom insulation not described herein.

In the embodiment described above, the space between the inner tank 18, 19 and the concrete outer wall 7 is fully filled up with insulating material, which in addition to the insulating effect also has the advantage of prevention of strong liquid surge upon rupture of the inner tank. Especially when the outer wall is sufficiently strong to resist this liquid surge, the interspace can be fully or partly left empty. Preferably, however, a moisture resistant lining of the outer wall will be used and a coating of purfoam. Also the use of more layers of purfoam is possible or complete filling-up with purfoam almost or fully up to the inner tank wall. The choice of these means can partly depend on the dimensions to be applied and the type of the tank contents.

I claim:

1. A storage tank for storing liquefied gas, such as natural gas, ethylene, propylene, ammonia, at low or cryogenic temperatures, comprising a base plate; a side wall structure supported on said base plate including an outer wall and an inner wall spaced from and surrounded by the outer wall; thermal insulation material filling the interspace between said walls, said outer wall being a reinforced concrete wall, tensioned wires in said outer wall for circumferentially pre-stressing said wall, said outer wall resting on said bottom plate, the inner side of the outer wall being coated with a layer of a foam of a polyurethane type, said layer merging at its lower end into an annular horizontal layer of the same material coating a portion of said base plate, an annular concrete layer covering said horizontal layer; sealing means inserted between said outer wall and said plate providing a liquid-tight connection between said wall and plate, said sealing means being a mortar of a bonding type; vertically tensioned wires being anchored in said outer wall and in said base plate for tensioning said outer wall with respect to said base plate.

2. A storage tank according to claim 1, comprising a cylindrical raised portion being formed on said base plate, the lower end of the outer wall closely surrounding said cylindrical raised portion on the base plate, and sealing means being inserted therebetween, said sealing means being of the same material as the sealing means inserted between the outer wall and the base plate.

3. A storage tank according to claim 1, comprising a cylindrical raised portion on the base plate closely surrounding the lower end of the outer wall, and a sealing means being inserted therebetween, said sealing means being of the same material as the sealing means inserted between the outer wall and the base plate.

4. A storage tank according to claim 1, wherein the tensioned wires with which the concrete wall is circumferentially pre-stressed are not bonded to the concrete.

* * * * *